US011634981B1

(12) United States Patent
Kumar et al.

(10) Patent No.: US 11,634,981 B1
(45) Date of Patent: Apr. 25, 2023

(54) GAUGE CUTTER AND LEAD IMPRESSION BLOCK APPARATUS

(71) Applicant: SAUDI ARABIAN OIL COMPANY, Dhahran (SA)

(72) Inventors: Sanjiv Kumar, Udhailiyah (SA); Muhammad Imran Javed, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/648,262

(22) Filed: Jan. 18, 2022

(51) Int. Cl.

| | |
|---|---|
| ***E21B 37/02*** | (2006.01) |
| ***E21B 47/098*** | (2012.01) |
| ***E21B 31/00*** | (2006.01) |
| *E21B 41/00* | (2006.01) |

(52) U.S. Cl.
CPC ..... *E21B 47/098* (2020.05); *E21B 37/02* (2013.01); *E21B 31/00* (2013.01); *E21B 41/00* (2013.01)

(58) Field of Classification Search
CPC ..... E21B 31/00; E21B 37/02; E21B 41/00; E21B 47/098
See application file for complete search history.

(56) References Cited

U.S. PATENT DOCUMENTS

| | | | | |
|---|---|---|---|---|
| 5,348,086 | A * | 9/1994 | Trout | E21B 31/16 166/99 |
| 10,954,752 | B2 | 3/2021 | Manson et al. | |
| 2017/0044874 | A1 | 2/2017 | Nicol et al. | |

FOREIGN PATENT DOCUMENTS

| | | |
|---|---|---|
| CN | 210440001 U | 5/2020 |

* cited by examiner

*Primary Examiner* — Robert E Fuller
*Assistant Examiner* — Lamia Quaim
(74) *Attorney, Agent, or Firm* — Osha Bergman Watanabe & Burton LLP

(57) ABSTRACT

An apparatus includes a gauge cutter, a lead impression block (LIB), a locking pin, and a locking device. The gauge cutter has a gauge cutter tubular body, a gauge cutter head, and an orifice. The LIB has an LIB body and an LIB head. The LIB is fixed in a first position within the orifice of the gauge cutter by being connected to an inner circumferential surface of the gauge cutter tubular body using a shear pin. The locking pin is disposed around the LIB body. The locking device is disposed around the inner circumferential surface of the gauge cutter tubular body and is configured to mate with the locking pin to hold the LIB in a second position within the gauge cutter. The second position includes a portion of the LIB body located within the orifice and the LIB head located outside of the orifice.

20 Claims, 6 Drawing Sheets

GAUGE CUTTER AND LEAD IMPRESSION BLOCK APPARATUS

BACKGROUND

In the oil and gas industry, hydrocarbons are located in porous rock formations far beneath the Earth's surface. Wells are drilled into the formations to access and produce the hydrocarbons. A well is made up of a hole, or wellbore, drilled into the Earth's surface. At least one casing string run and cemented in place in the wellbore. Production tubing is often run into the casing string to produce the hydrocarbons. Wells may operate for decades at a time and will undergo routine or emergency maintenance operations.

When an operation needs to be performed on a well, a gauge cutter must be run into the casing or the production tubing to check the casing/tubing clearance. The gauge cutter may encounter a downhole obstruction that cannot be cleared using the sharp edges of the gauge cutter. In this scenario, the gauge cutter is removed from the well and a lead impression block is run into the well to get an impression of the obstruction. The impression of the obstruction aids in determining the type of fishing or clearing tool needs to be run to clear the casing/tubing.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and an apparatus for use in a well having tubing and an obstruction. The apparatus includes a gauge cutter, a lead impression block (LIB), a locking pin, and a locking device. The gauge cutter has a gauge cutter tubular body, a gauge cutter head, and an orifice. The orifice extends through the gauge cutter tubular body and the gauge cutter head. The LIB has an LIB body and an LIB head. The LIB is fixed in a first position within the orifice of the gauge cutter by being connected to an inner circumferential surface of the gauge cutter tubular body using a shear pin. The locking pin is disposed around the LIB body. The locking device is disposed around the inner circumferential surface of the gauge cutter tubular body and is configured to mate with the locking pin to hold the LIB in a second position within the gauge cutter. The second position includes a portion of the LIB body located within the orifice and the LIB head located outside of the orifice.

The method includes providing a downhole apparatus having an LIB placed in a first position and disposed within an orifice of a gauge cutter. The gauge cutter has a gauge cutter head and the LIB has an LIB body and an LIB head. The method further includes running the downhole apparatus into the well, drifting the tubing using the gauge cutter head, and breaking a shear pin to place the LIB in a second position. The second position includes a portion of the LIB body located within the orifice and the LIB head located outside of the orifice. The method finally includes obtaining an impression of the obstruction located in the tubing using the LIB head.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1A:
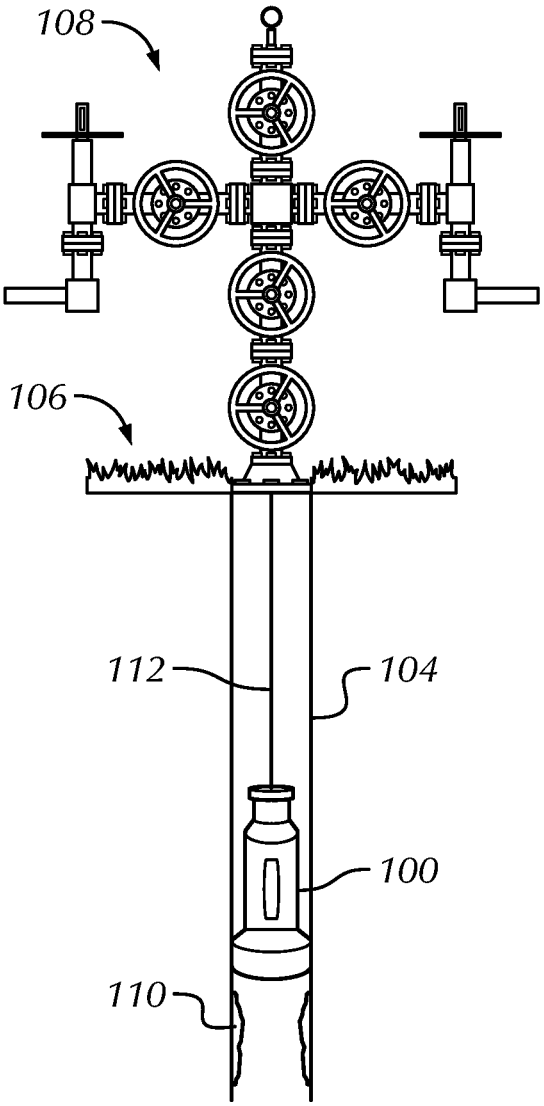
FIG. 1*a* shows a gauge cutter disposed in tubing and FIG. 1*b* shows a lead impression block (LIB) disposed in tubing in accordance with one or more embodiments.
Figure 1B:
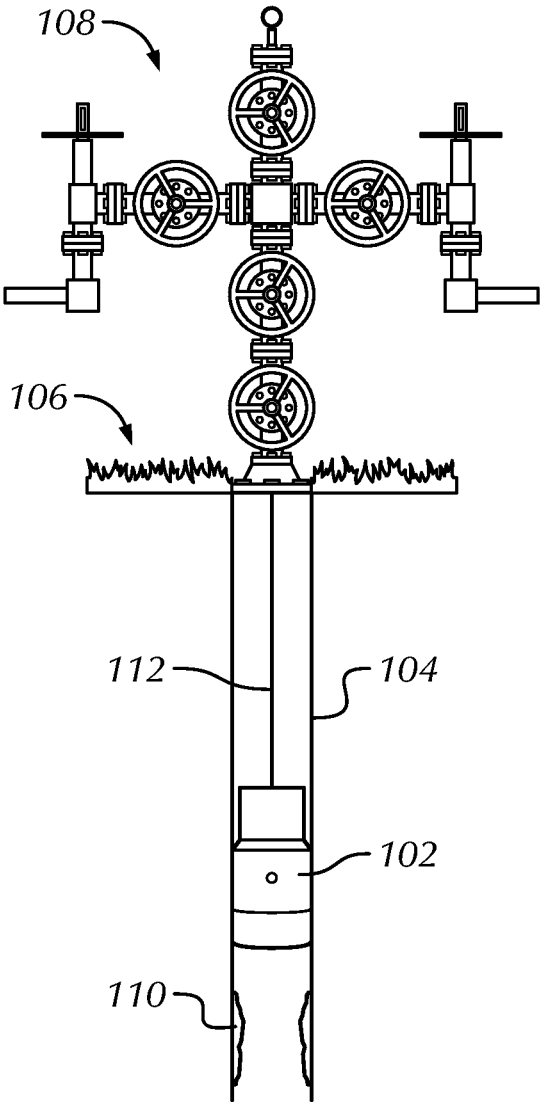

FIG. 1*a* shows a gauge cutter (100) disposed in tubing and FIG. 1*b* shows a lead impression block (LIB) (102) disposed in tubing in accordance with one or more embodiments. The tubing may be a casing string (104) as shown in FIGS. 1*a* and 1*b*, or the tubing may be a production string/tubing without departing from the scope of the disclosure herein. A casing string (104) is a plurality of large-diameter pipes threaded together. The pipe may be made out of any durable material known in the art, such as a steel alloy. The casing string (104) may be supporting a wellbore (not pictured) drilled into the surface of the Earth.

The casing string (104) is capped at a surface location (106) using a production tree (108). The surface location (106) is any location located on or above the surface of the Earth. The production tree (108) is a series of valves and spools that may be used to access the casing string (104) and/or produce hydrocarbons from the casing string (104). In further embodiments, the production tree (108) may be capping a wellhead (not pictured) that houses the surface-extending portion of the casing string (104). An obstruction (110) is shown in the casing string (104). The obstruction (110) may be the result of scale, metal corrosion/erosion, mechanical failures of the casing string (104), or a dropped object.

The gauge cutter (100) is run into the casing string (104), as shown in FIG. 1*a*, to check the tubing clearance and find obstructions (110). A gauge cutter (100) is a downhole tool that may be run into the casing string (104) on a flexible line (112), such as wireline or slickline. The gauge cutter (100) gauges, scrapes, or drifts the casing string (104). The gauge cutter (100) may scrape clean paraffin, wax, and other debris from the inside wall of the casing string (104). In some scenarios, the gauge cutter (100) is able to clear the obstruction (110).

However, in other scenarios, the gauge cutter (100) may be unable to clear the obstruction (110) and the gauge cutter (100) must be removed from the casing string (104) such that an LIB (102) may be run into the casing string (104). An LIB (102) is a tool made of a soft metal, such as lead, and may be run into the casing string (104) on the flexible line (112) as shown in FIG. 1*b*. The LIB (102) taps the obstruction (110) to obtain an impression of the obstruction (110) downhole to assist in the identification of the object and thus aid in the selection of the correct fishing tool.

Current methods of running the gauge cutter (100) and the LIB (102) require the operation to be performed in two separate trips, as shown in FIGS. 1*a* and 1*b*, due to the design of the available equipment. Therefore, an apparatus that allows the gauge cutter (100) and the LIB (102) to be run into tubing on one trip, is beneficial. As such, embodiments herein present a downhole apparatus (200) that is made of an LIB (102) disposed within a gauge cutter (100). The downhole apparatus (200) is designed such that the gauge cutter (100) may be used downhole until it is necessary to deploy the LIB (102) from the gauge cutter (100) to obtain an impression of an obstruction (110).

Figure 2A:
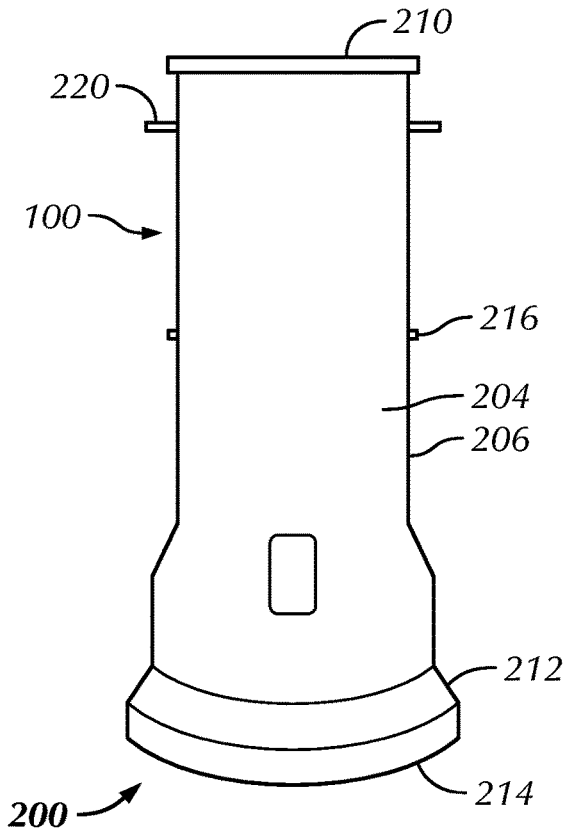
FIGS. 2*a* and 2*b* show a downhole apparatus in accordance with one or more embodiments.
Figure 2B:
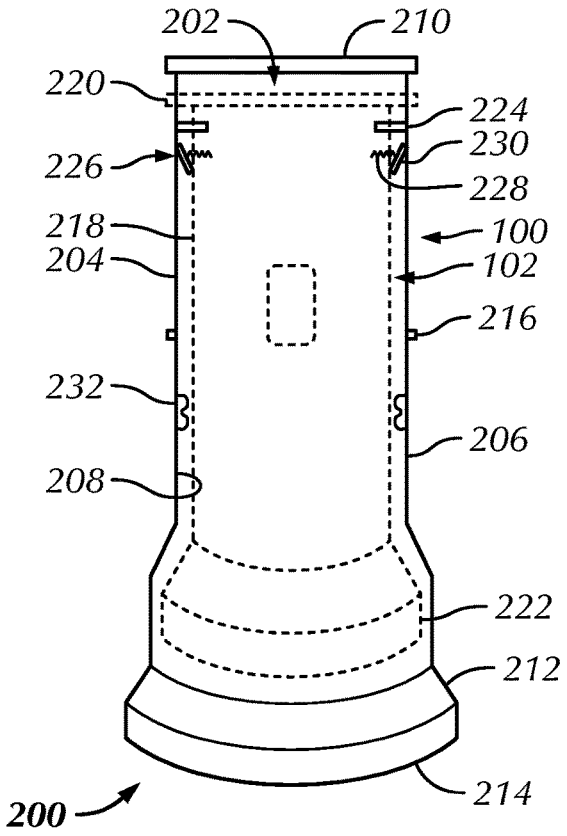

FIGS. 2*a* and 2*b* show the downhole apparatus (200) in accordance with one or more embodiments. Specifically, FIG. 2*a* shows a side view of the downhole apparatus (200) and FIG. 2*b* shows a partial cross section of the downhole apparatus (200). Components shown in FIGS. 2*a* and 2*b* that are the same as or similar to components described in FIG. 1 have not been redescribed for purposes of readability and have the same description and purpose as previously outlined.

The downhole apparatus (200) is made of a LIB (102) disposed within an orifice (202) of a gauge cutter (100). The gauge cutter (100) is made of a gauge cutter tubular body (204). The gauge cutter tubular body (204) is defined by an external circumferential surface (206) and an inner circumferential surface (208). The external circumferential surface (206) and the inner circumferential surface (208) connects a gauge cutter fish neck (210) on one end of the gauge cutter tubular body (204) to a gauge cutter head (212) on an opposite end of the gauge cutter tubular body (204).

The orifice (202) extends through the gauge cutter tubular body (204) and the gauge cutter head (212). The gauge cutter fish neck (210) may be solid or may have the orifice (202) extending therein. The gauge cutter fish neck (210) may be located up hole from the gauge cutter head (212) when the downhole apparatus (200) is deployed in tubing. As such, the gauge cutter fish neck (210) is designed to be fishable by a fishing tool.

The gauge cutter head (212) has a sharp edge (214) that may scrape an obstruction (110) off of a tubing wall. The components of the gauge cutter (100) may be made out of any durable material known in the art, such as a steel alloy. In accordance with one or more embodiments, the sharp edge (214) of the gauge cutter head (212) may be made out of a stronger material than the rest of the gauge cutter (100) to aid in scraping the tubing wall.

A LIB fish neck rest (216) is located on the external circumferential surface (206) of the downhole apparatus (200). The LIB fish neck rest (216) juts out from the external circumferential surface (206). The LIB fish neck rest (216) may be a couple pieces of metal, or a ring of metal, welded or otherwise connected to the external circumferential surface (206) of the gauge cutter (100). The LIB (102) is made of a LIB body (218) that may be solid or may have an orifice.

The LIB body (218) is capped on one end by a LIB fish neck (220) and capped on the opposite end by a LIB head (222). The LIB fish neck (220) extends through slots (not pictured) in the gauge cutter tubular body (204) such that the LIB fish neck (220) extends from the external circumferential surface (206) as shown in FIG. 2*a*. The slots in the gauge cutter tubular body (204) extend to the LIB fish neck rest (216) such that the LIB fish neck (220) may move to and touch the LIB fish neck rest (216).

The LIB head (222) may be made out of a soft metal, such as lead, in order to be able to make an impression of an obstruction (110). The LIB body (218) and the LIB fish neck (220) may be made out of any durable material known the in the art, such as a steel alloy. FIG. 2*a* shows the LIB (102) fixed in a first position within the orifice (202).

The LIB (102) is fixed in the first position by one or more shear pins (224) extending from the LIB body (218) to the inner circumferential surface (208) of the gauge cutter tubular body (204). The shear pins (224) are designed to break, or shear, when a force is seen across the shear pins (224). In accordance with one or more embodiments, the shear pins (224) may be brass pins or steel pins. The brass pins require less force than steel pins to break.

The first position requires the entire LIB body (218) and LIB head (222) to be located within the orifice (202) of the gauge cutter (100). As shown in FIG. 2*b*, a locking pin (226) is disposed around the LIB body (218). The locking pin (226) is configured to mate with a locking device (232) to hold the LIB (102) in a second position. In accordance with one or more embodiments, the locking pin (226) is made of a spring (228) and a lock ring (230). The spring (228) extends from the LIB body (218) to the lock ring (230).

In accordance with one or more embodiments, a portion of the lock ring (230) is touching, or connected to, the LIB body (218). A portion of the lock ring (230) is touching the inner circumferential surface (208) of the gauge cutter (100) due to the force of the spring (228). The locking device (232) is disposed around the inner circumferential surface (208) of the gauge cutter tubular body (204). As shown in FIG. 2*b*, the locking device (232) may have a bimodal shape facing the LIB body (218).

Figure 3:
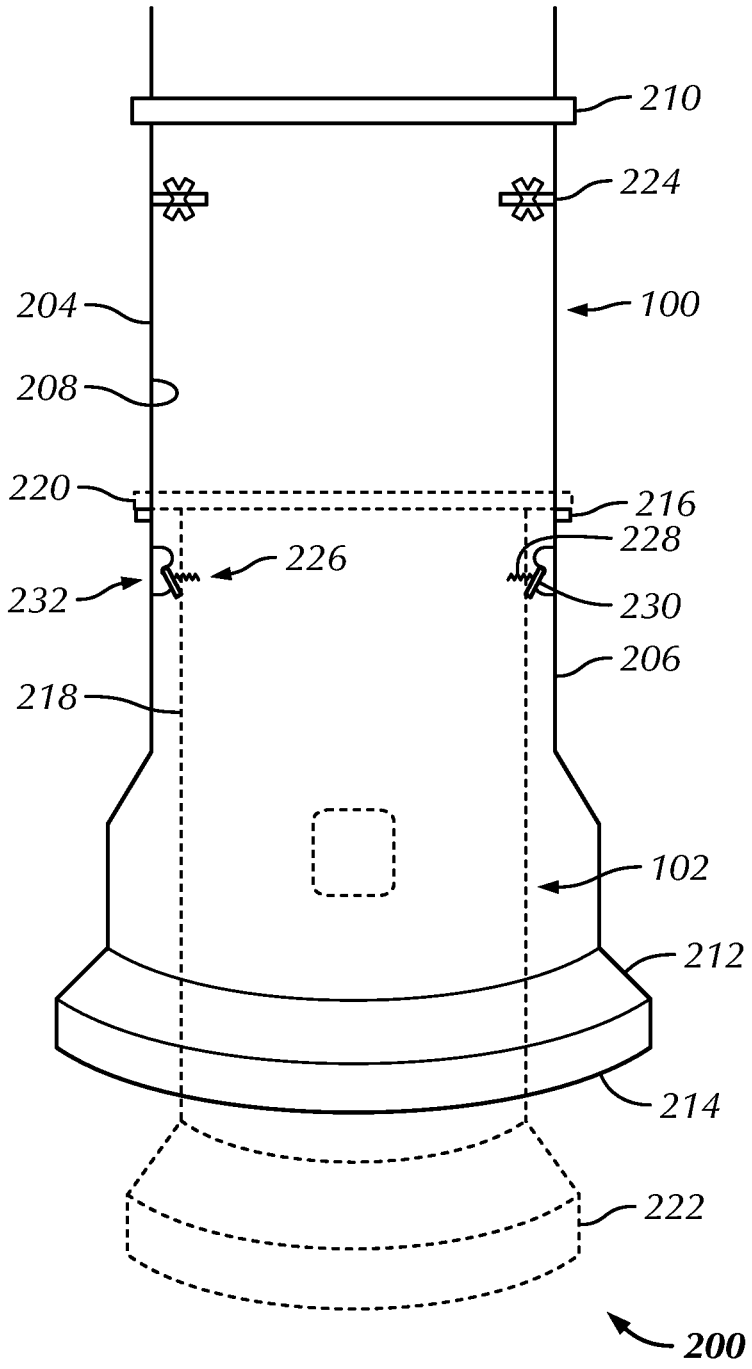
FIG. 3 shows the downhole apparatus in a second position and in accordance with one or more embodiments.

FIG. 3 shows the downhole apparatus (200) in a second position and in accordance with one or more embodiments. Components shown in FIG. 3 that are the same as or similar to components described in FIGS. 1-2*b* have not been redescribed for purposes of readability and have the same description and purpose as previously outlined. The downhole apparatus (200) may be placed in the second position due to the breaking or shearing of the shear pins (224). As such, FIG. 3 shows the shear pins (224) broken.

Because the LIB (102) is no longer attached to the inner circumferential surface (208) of the gauge cutter (100), the LIB (102) is free to move downhole due to gravity. More specifically, the LIB (102) moves within the gauge cutter (100) until the LIB fish neck (220) rests on the LIB fish neck rest (216) and the locking pin (226) is engaged in the locking device (232). Further, the second position includes a portion of the LIB body (218) located within the orifice (202) and the LIB head (222) located outside of the orifice (202). In accordance with one or more embodiments, the LIB fish neck rest (216) prevents the LIB (102) from moving further downhole and the locking device (232) prevents the LIB (102) from moving back up hole. The engagement between the locking pin (226) and the locking device (232) is further outlined in FIGS. 4*a* and 4*b*.

Figure 4A:
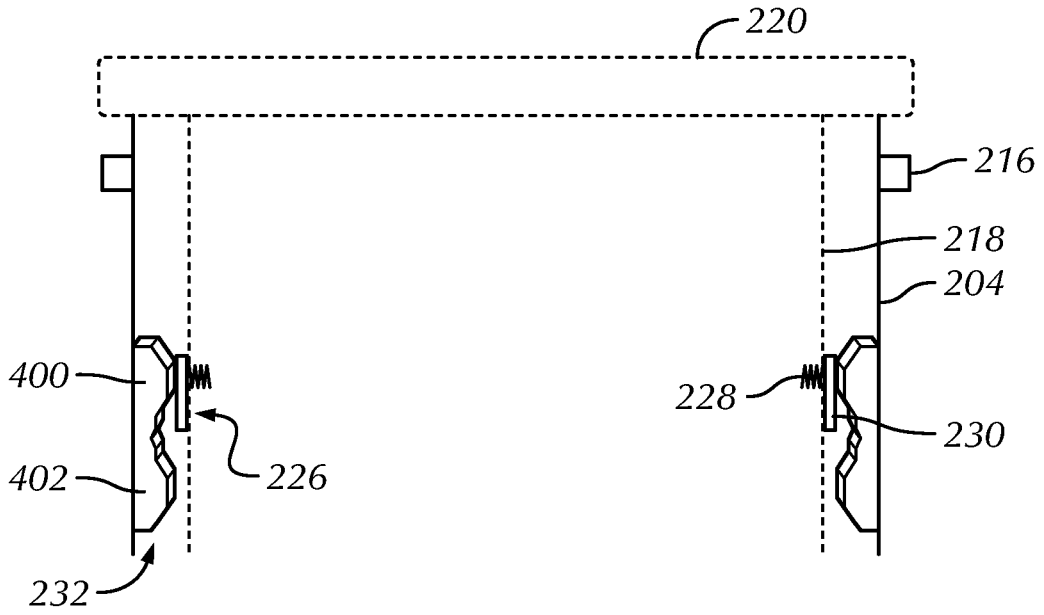
FIG. 4*a* shows a locking pin in a compressed position and FIG. 4*b* shows the locking pin in an uncompressed position and in accordance with one or more embodiments.
Figure 4B:
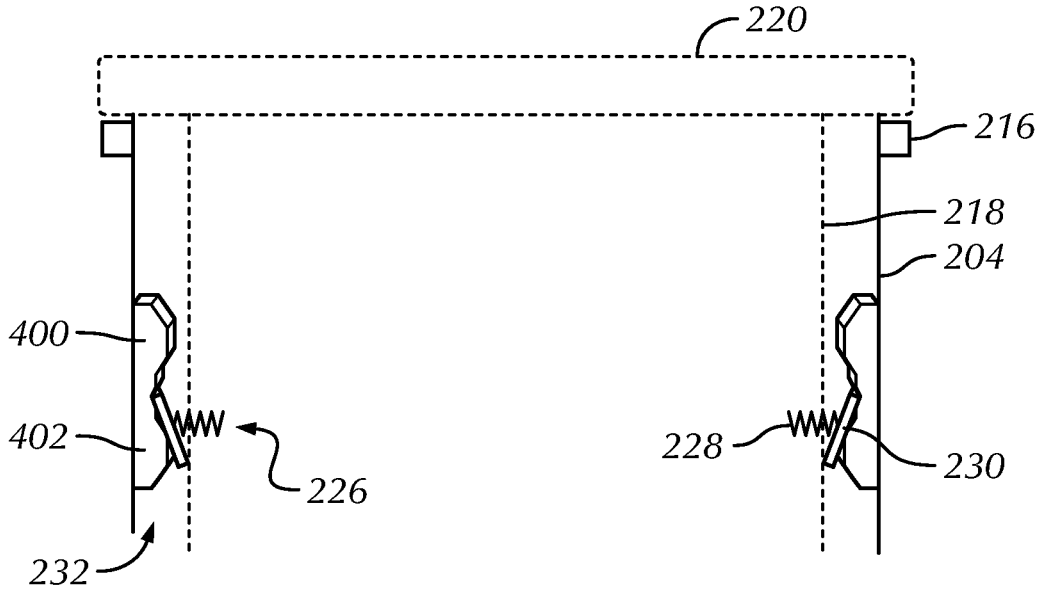

FIG. 4*a* shows the locking pin (226) in a compressed position and FIG. 4*b* shows the locking pin (226) in an uncompressed position and in accordance with one or more embodiments. Components shown in FIGS. 4*a* and 4*b* that are the same as or similar to components described in FIGS. 1-3 have not been redescribed for purposes of readability and have the same description and purpose as previously outlined.

As explained above, the locking device (232) may have a bimodal shape that includes a first bump (400) and a second bump (402). As shown in FIG. 4*a*, when the shear pins (224) break and the locking pin (226) passes the locking device (232), the first bump (400) compresses the lock ring (230) against the LIB body (218). Further, the spring (228) is compressed into the LIB body (218). As shown in FIG. 4*b*, when the locking pin (226) passes the first bump (400), the spring (228) and the lock ring (230) become uncompressed, and the spring (228) pushes the lock ring (230) into the locking device (232). The uncompressed position includes a section of the lock ring (230) and the spring (228) extended away from the LIB body (218).

Figure 5A:
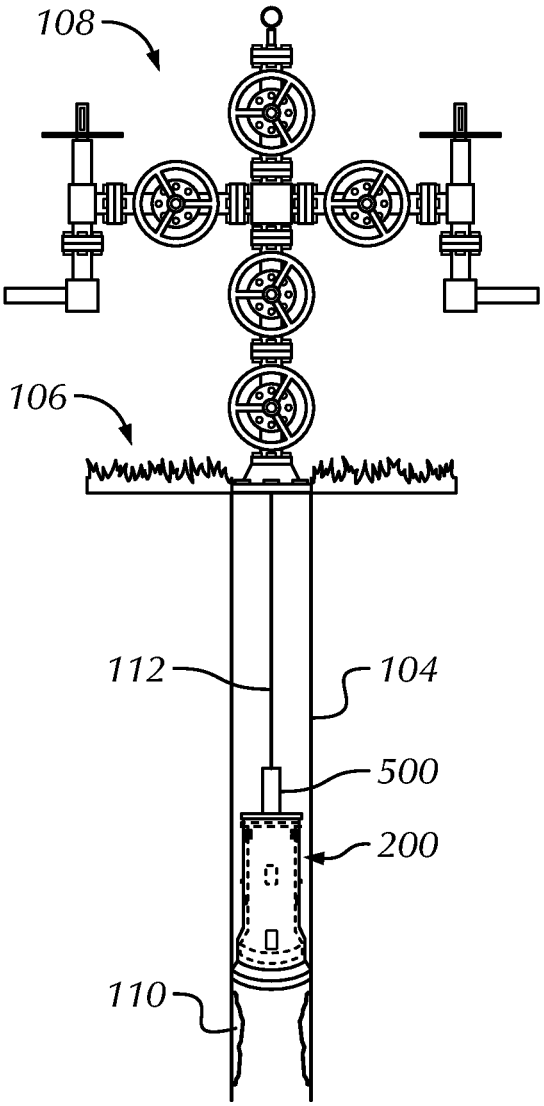
FIGS. 5*a* and 5*b* show the downhole apparatus deployed in tubing and in accordance with one or more embodiments.
Figure 5B:
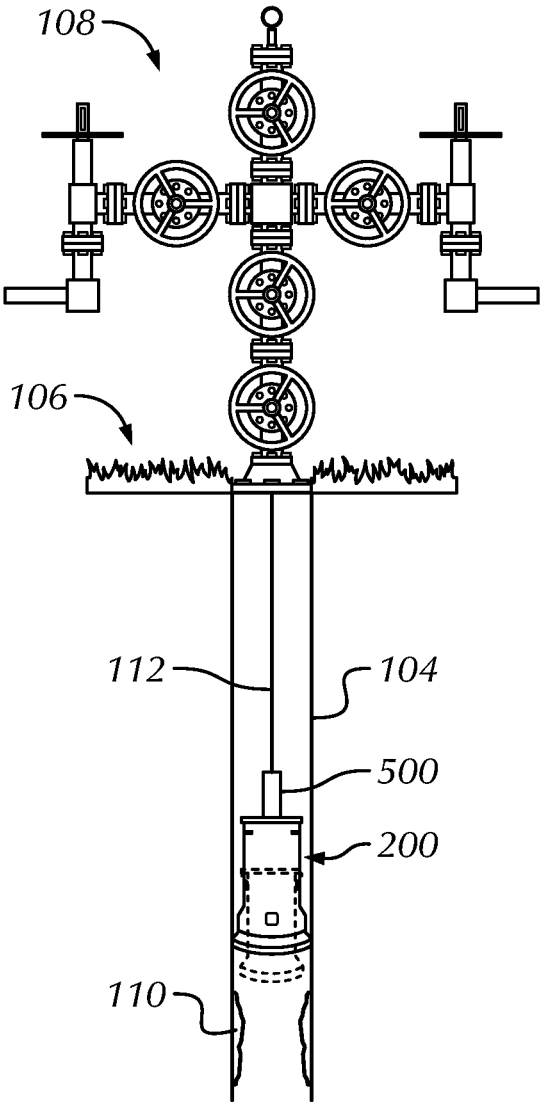

FIGS. 5*a* and 5*b* show the downhole apparatus (200) deployed in tubing and in accordance with one or more embodiments. Components shown in FIGS. 5*a* and 5*b* that are the same as or similar to components described in FIGS. 1-4*b* have not been redescribed for purposes of readability and have the same description and purpose as previously outlined. The downhole apparatus (200) is deployed in tubing on a flexible line (112). In accordance with one or more embodiments, the flexible line (112) may be a wireline.

The tubing may be a casing string (104), as shown in FIGS. 5*a* and 5*b*, or the tubing may be a production string/tubing without departing from the scope of the disclosure herein. In accordance with one or more embodiments, a set of jars (500) is connected to the gauge cutter fish neck (210) of the downhole apparatus (200). The set of jars (500) may be wireline or slickline jars. The wireline jars may operate based on a signal, sent from the surface location (106) to the set of jars (500) using the wireline. The set of jars (500) are configured to apply a force to the shear pins (224) to break the shear pins (224).

FIG. 5*a* shows the downhole apparatus (200) in the first position. While in the first position, the downhole apparatus (200) may be used to gauge, drift, and/or scrape the casing string (104) using the gauge cutter head (212). FIG. 5*b* shows the downhole apparatus (200) in the second position. While in the second position, the LIB head (222) is extended from the gauge cutter head (212). The downhole apparatus (200) may be lowered to tap the LIB head (222) on the obstruction (110) to obtain an impression of the obstruction (110).

Figure 6:
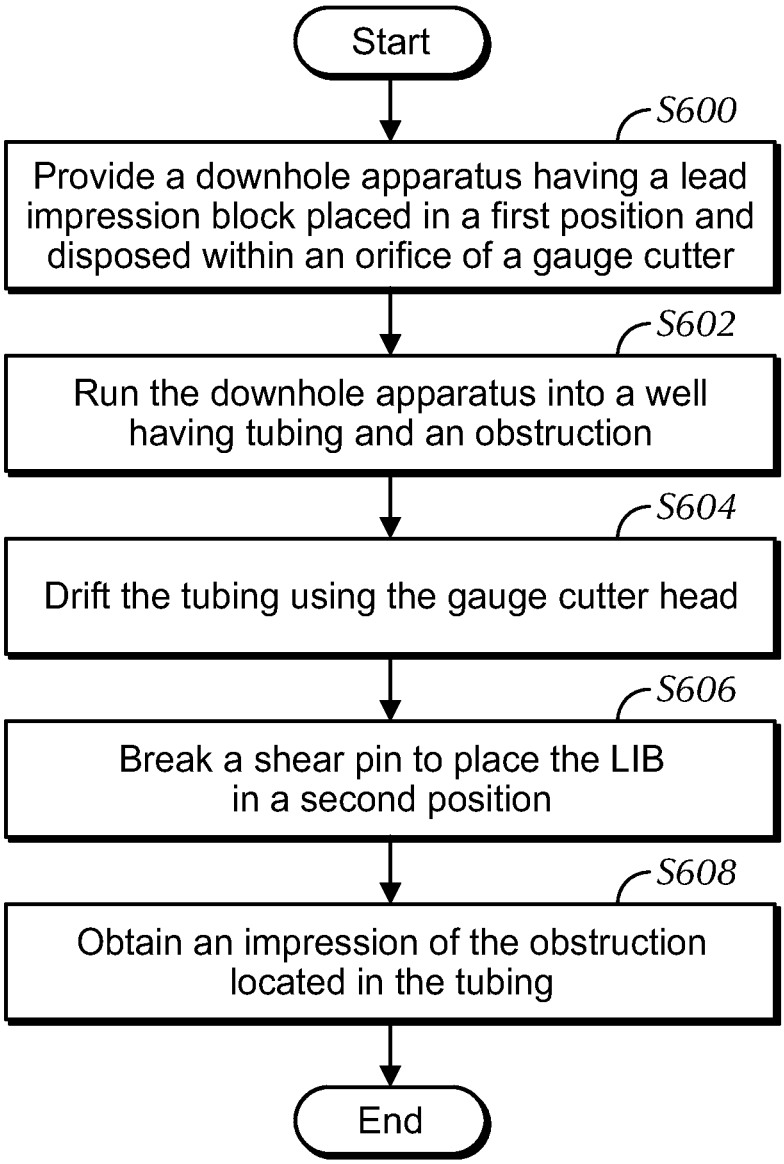
FIG. 6 shows a flowchart in accordance with one or more embodiments.

FIG. 6 shows a flowchart in accordance with one or more embodiments. The flowchart outlines a method for deploying a downhole apparatus (200). While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a downhole apparatus (200) having an LIB (102) placed in a first position and disposed within an orifice (202) of a gauge cutter (100) is provided (S600). The LIB (102) is fixed in the first position due to one or more shear pins (224) connecting an LIB body (218) to an inner circumferential surface (208) of the gauge cutter tubular body (204). A set of jars (500) is attached to the downhole apparatus (200). Specifically, the set of jars (500) is connected to the gauge cutter fish neck (210) of the gauge cutter (100). A flexible line (112) is attached to the set of jars (500). The flexible line (112) may be wireline or slickline without departing from the scope of the disclosure herein.

The downhole apparatus (200) is run into a well having tubing and an obstruction (110) (S602). The tubing may be a casing string (104). In accordance with one or more embodiments, the downhole apparatus (200) is run into the well using the flexible line (112). The tubing is drifted using the gauge cutter head (212) (S604). In accordance with one or more embodiments, while the tubing is being drifted, the tubing is scraped using the sharp edge (214) of the gauge cutter head (212). While the tubing is being drifted, the downhole apparatus (200) may encounter an obstruction (110) that is unable to be cleared by the gauge cutter head (212). As such, the LIB (102) may be deployed by placing the downhole apparatus (200) in a second position.

A shear pin (224) is broken to place the LIB (102) in a second position (S606). The set of jars (500) is activated to apply a force to the shear pin (224) to break the shear pin (224). The set of jars (500) may be activated by a signal sent from a surface location (106) along the flexible line (112) to the set of jars (500). When the shear pin (224) is broken, the LIB (102) is able to move downhole within the gauge cutter (100) orifice (202). As the LIB (102) passes a locking device (232) on the inner circumferential surface (208) of the gauge cutter (100), a locking pin (226) on the LIB (102) is compressed against/into the LIB body (218) using the locking device (232). The locking pin (226) is then uncompressed to insert the locking pin (226) into the locking device (232) and fix the LIB (102) in the second position.

An impression of the obstruction (110), located in the tubing, is obtained (S608). Specifically, the LIB head (222) is tapped against the obstruction to form an impression of the obstruction (110) on the soft metal of the LIB head (222). When the impression of the obstruction (110) is obtained, or the entire casing string (104) has been drifted, the downhole apparatus (200) may be pulled out of the well to the surface location (106).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. An apparatus comprising:

a gauge cutter having a gauge cutter tubular body, a gauge cutter head, and an orifice, wherein the orifice extends through the gauge cutter tubular body and the gauge cutter head;

a lead impression block (LIB) having an LIB body and an LIB head, wherein the LIB is fixed in a first position within the orifice of the gauge cutter by being connected to an inner circumferential surface of the gauge cutter tubular body using a shear pin;

a locking pin disposed around the LIB body; and a locking device disposed around the inner circumferential surface of the gauge cutter tubular body, the locking device configured to mate with the locking pin to hold the LIB in a second position within the gauge cutter, wherein the second position includes a portion of the LIB body located within the orifice and the LIB head located outside of the orifice.

2. The apparatus of claim 1, wherein the gauge cutter further comprises a gauge cutter fish neck connected to an end of the gauge cutter tubular body opposite the gauge cutter head.

3. The apparatus of claim 2, further comprising a set of jars connected to the gauge cutter fish neck, the set of jars configured to apply a force to the shear pin to break the shear pin.

4. The apparatus of claim 1, further comprising a LIB fish neck rest located on an external circumferential surface of the gauge cutter tubular body.

5. The apparatus of claim 4, wherein the LIB further comprises a LIB fish neck connected to an end of the LIB body opposite the LIB head.

6. The apparatus of claim 5, wherein the second position further includes the LIB fish neck touching the LIB fish neck rest.

7. The apparatus of claim 1, wherein the locking pin further comprises a spring and a lock ring.

8. The apparatus of claim 7, wherein the locking pin includes a compressed position and an uncompressed position.

9. The apparatus of claim 8, wherein the compressed position includes the lock ring pushed against the LIB body and the spring compressed within the LIB body.

10. The apparatus of claim 8, wherein the uncompressed position includes a section of the lock ring and the spring extended from the LIB body.

11. A method for a well having tubing and an obstruction, the method comprising:

providing a downhole apparatus having an LIB placed in a first position and disposed within an orifice of a gauge cutter, wherein the gauge cutter has a gauge cutter head and the LIB has an LIB body and an LIB head;

running the downhole apparatus into the well;

drifting the tubing using the gauge cutter head;

breaking a shear pin to place the LIB in a second position, the second position including a portion of the LIB body located within the orifice and the LIB head located outside of the orifice; and obtaining an impression of the obstruction located in the tubing using the LIB head.

12. The method of claim 11, wherein providing the downhole apparatus further comprises attaching a set of jars to the downhole apparatus.

13. The method of claim 12, wherein running the downhole apparatus into the well further comprises attaching a flexible line to the set of jars and running the downhole apparatus into the well using the flexible line.

14. The method of claim 13, wherein breaking the shear pin further comprises activating the set of jars to apply a force to the shear pin.

15. The method of claim 14, wherein activating the set of jars further comprises sending a signal from a surface location along the flexible line to the set of jars.

16. The method of claim 11, wherein breaking the shear pin to place the LIB in the second position further comprises compressing a locking pin against the LIB body using a locking device.

17. The method of claim 16, wherein breaking the shear pin to place the LIB in the second position further comprises uncompressing the locking pin to insert the locking pin into the locking device.

18. The method of claim 11, wherein obtaining the impression of the obstruction using the LIB head further comprises tapping the LIB head against the obstruction.

19. The method of claim 11, further comprising pulling the downhole apparatus out of the well.

20. The method of claim 11, wherein drifting the tubing using the gauge cutter head further comprises scraping the tubing using a sharp edge on the gauge cutter head.

* * * * *